US008485890B2

(12) United States Patent
Gagner et al.

(10) Patent No.: US 8,485,890 B2
(45) Date of Patent: Jul. 16, 2013

(54) WAGERING GAME AWARD SYSTEM

(75) Inventors: Mark B. Gagner, West Chicago, IL (US); Jeremy M. Hornik, Chicago, IL (US); Shridhar P. Joshi, Naperville, IL (US); Mark C. Pace, Palatine, IL (US); Larry J. Pacey, Northbrook, IL (US); Richard T. Schwartz, Chicago, IL (US); Alfred Thomas, Las Vegas, NV (US)

(73) Assignee: WMS Gaming, Inc., Waukegan, IL (US)

( * ) Notice: Subject to any disclaimer, the term of this patent is extended or adjusted under 35 U.S.C. 154(b) by 670 days.

(21) Appl. No.: 12/513,609

(22) PCT Filed: Nov. 9, 2007

(86) PCT No.: PCT/US2007/084210

§ 371 (c)(1),
(2), (4) Date: May 7, 2009

(87) PCT Pub. No.: WO2008/060978

PCT Pub. Date: May 22, 2008

(65) Prior Publication Data

US 2010/0041472 A1 Feb. 18, 2010

Related U.S. Application Data

(60) Provisional application No. 60/865,399, filed on Nov. 10, 2006.

(51) Int. Cl.
*A63F 9/24* (2006.01)

(52) U.S. Cl.
USPC ..... 463/25

(58) Field of Classification Search
USPC ..... 463/16, 18, 25
See application file for complete search history.

(56) References Cited

U.S. PATENT DOCUMENTS

| | | | |
|---|---|---|---|
| 5,639,088 | A | 6/1997 | Schneider et al. |
| 5,655,961 | A | 8/1997 | Acres et al. |
| 5,833,540 | A | 11/1998 | Miodunski et al. |
| 5,851,148 | A | 12/1998 | Brune et al. |

(Continued)

FOREIGN PATENT DOCUMENTS

| | | |
|---|---|---|
| EP | 1513114 A2 | 9/2005 |
| GB | 2456964 | 8/2009 |

(Continued)

OTHER PUBLICATIONS

Amendment and response under PCT Article 34 for Int'l Application No. PCT/US2007/084210.*

(Continued)

*Primary Examiner* — Brook Kebede
(74) *Attorney, Agent, or Firm* — DeLizio Gilliam, PLLC

(57) ABSTRACT

A wagering game award system is described herein. In some embodiments, the wagering game award system detects a player identifier associated with a wagering game award system, where the wagering game award system supports a plurality of award types. The system can also determine a number of awards of a first type, wherein the number of awards are associated with the player identifier, and wherein the first type is one of the award types. The system can also detect a request to exchange some of the number of awards for awards of a second type, wherein the second type is one of the award types. The system can also submit the request.

24 Claims, 13 Drawing Sheets

U.S. PATENT DOCUMENTS

| | | | | |
|---|---|---|---|---|
| 6,146,273 | A | 11/2000 | Olsen | |
| 6,165,071 | A | 12/2000 | Weiss | |
| 6,183,362 | B1 | 2/2001 | Boushy | |
| 6,193,608 | B1 | 2/2001 | Walker et al. | |
| 6,227,972 | B1 | 5/2001 | Walker et al. | |
| 6,244,958 | B1 | 6/2001 | Acres | |
| 6,254,483 | B1 | 7/2001 | Acres | |
| 6,371,852 | B1 | 4/2002 | Acres | |
| 6,379,248 | B1 | 4/2002 | Jorasch et al. | |
| 6,422,940 | B1 | 7/2002 | Walker et al. | |
| RE37,885 | E | 10/2002 | Acres et al. | |
| 6,558,255 | B2 | 5/2003 | Walker et al. | |
| 6,575,832 | B1 | 6/2003 | Manfredi et al. | |
| 6,607,441 | B1 | 8/2003 | Acres | |
| 6,712,697 | B2 | 3/2004 | Acres | |
| 6,776,711 | B1 | 8/2004 | Baerlocher | |
| 6,800,030 | B2 | 10/2004 | Acres | |
| 6,875,106 | B2 | 4/2005 | Weiss et al. | |
| 6,878,063 | B2 | 4/2005 | Manfredi et al. | |
| 6,896,618 | B2 | 5/2005 | Benoy et al. | |
| RE38,812 | E | 10/2005 | Acres et al. | |
| 7,025,674 | B2 | 4/2006 | Adams et al. | |
| 7,063,617 | B2 | 6/2006 | Brosnan et al. | |
| 7,507,156 | B2 * | 3/2009 | Nicely | 463/25 |
| 7,618,319 | B2 * | 11/2009 | Casey et al. | 463/25 |
| 2002/0142846 | A1 | 10/2002 | Paulsen | |
| 2002/0195773 | A1 | 12/2002 | Dunn | |
| 2003/0032474 | A1 | 2/2003 | Kaminkow | |
| 2003/0186739 | A1 * | 10/2003 | Paulsen et al. | 463/25 |
| 2004/0106448 | A1 | 6/2004 | Gauselmann | |
| 2004/0127284 | A1 | 7/2004 | Walker et al. | |
| 2004/0142742 | A1 | 7/2004 | Schneider et al. | |
| 2004/0142750 | A1 | 7/2004 | Glisson et al. | |
| 2004/0162144 | A1 | 8/2004 | Loose et al. | |
| 2004/0235552 | A1 | 11/2004 | Gauselmann | |
| 2005/0003887 | A1 | 1/2005 | Seelig | |
| 2005/0054439 | A1 | 3/2005 | Rowe et al. | |
| 2005/0059480 | A1 | 3/2005 | Soukup et al. | |
| 2005/0075889 | A1 | 4/2005 | Gomes et al. | |
| 2005/0101374 | A1 | 5/2005 | Acres | |
| 2005/0221881 | A1 | 10/2005 | Lannert et al. | |
| 2006/0046839 | A1 | 3/2006 | Nguyen | |
| 2006/0116201 | A1 | 6/2006 | Gauselmann | |
| 2006/0143085 | A1 | 6/2006 | Adams et al. | |
| 2006/0160611 | A1 | 7/2006 | Okada | |
| 2006/0211486 | A1 | 9/2006 | Walker et al. | |
| 2006/0211487 | A1 | 9/2006 | Walker et al. | |
| 2006/0211488 | A1 | 9/2006 | Walker et al. | |
| 2007/0105613 | A1 | 5/2007 | Adams et al. | |
| 2007/0111787 | A1 | 5/2007 | Adams et al. | |

FOREIGN PATENT DOCUMENTS

| | | |
|---|---|---|
| WO | WO-9744750 | 11/1997 |
| WO | WO-9852665 | 11/1998 |
| WO | WO-9916519 | 4/1999 |
| WO | WO-9960498 | 11/1999 |
| WO | WO-0183062 | 11/2001 |
| WO | WO-0183063 | 11/2001 |
| WO | WO02/30534 | 4/2002 |
| WO | WO-03013678 | 2/2003 |
| WO | WO-03025867 | 3/2003 |
| WO | WO-03026756 | 4/2003 |
| WO | WO-2005027063 | 3/2005 |
| WO | WO-2005029287 | 3/2005 |
| WO | WO-2005097280 | 10/2005 |
| WO | WO2006014833 | 2/2006 |
| WO | WO-2006020413 | 2/2006 |
| WO | WO-2006/044252 A2 | 4/2006 |
| WO | WO2008060978 | 5/2008 |

OTHER PUBLICATIONS

U.S. Appl. No. 60/843,635, Arezina, Vladimir I., et al.

"UK Application No. 0908724.8 Examination Report", Mar. 10, 2011 , 4 pages.

"UK Application No. 0908724.8 Office Action", Nov. 18, 2011 , 2 pages.

"UK Application No. 0908724.8 Office Action", Nov. 28, 2011 , 4 pages.

"UK Application No. 0908724.8 Search Report", Nov. 28, 2011 , 3 pages.

"UK Application No. 0908724.8 Examination Report", Apr. 24, 2012 , 2 pages.

"PCT Application No. PCT/US2007/084210 International Preliminary Report on Patentability", Feb. 22, 2013 , 4 pages.

* cited by examiner

WAGERING GAME AWARD SYSTEM

RELATED APPLICATIONS

This application claims the priority benefit of U.S. Provisional Application Ser. No. 60/865,399 filed Nov. 10, 2006.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2006, WMS Gaming, Inc.

FIELD

Embodiments of the inventive subject matter relate generally to wagering game systems, and more particularly to techniques for handling awards in wagering game systems.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

SUMMARY

In some embodiments, a method includes detecting a player identifier associated with a wagering game award system, where the wagering game award system supports a plurality of award types. The method can also include determining a number of awards of a first type, wherein the number of awards are associated with the player identifier, and wherein the first type is one of the award types. The method can also include detecting a request to exchange some of the number of awards for awards of a second type, wherein the second type is one of the award types. The method can also include submitting the request.

In some embodiments, the method is further comprises detecting a result of the request; and presenting the result of the request.

In some embodiments, before the request, the awards of the first type belong to a player associated with the player identifier, and wherein the awards of the second type belong to another player.

In some embodiments, before the request, the awards of the first type belong to a player associated with the player identifier, and wherein the awards of the second type do not belong to another player.

In some embodiments, the first type and the second type are not currency issued by a world government.

In some embodiments, submitting the request includes, transmitting the request to an award system server, and wherein a result of the request is received from the award server.

In some embodiments, the determining the number of awards of the first type includes obtaining information from an award system server or a player tracking card.

In some embodiments, the awards of the first type were given to a player associated with the player identifier by an entity other than the wagering game award system or another player associated with the wagering game award system.

In some embodiments, the entity is selected from the group consisting of a casino system, a service provider, a goods provider, or an advertiser.

In some embodiments, the awards of the first type were given to a player associated with the player identifier by another player associated with the wagering game system, wherein the other player had received the awards with a stipulation that the awards must be given away.

In some embodiments, a certain one of the number of awards is a mystery award, and wherein the value of the certain one of the number of awards is hidden.

In some embodiments, a method comprising submitting a request to purchase awards of a particular type, the awards being of a wagering game system that supports a plurality of award types. The method can also include detecting an indication that the awards have been purchased, determining a set of wagering game system activities, and requesting that ones of the awards be transferred to accounts associated with players of the wagering game system upon detection of the wagering game activities.

In some embodiments, the wagering game system activities are selected from the group consisting of watching an advertisement online, watching an advertisement on a wagering game machine, playing a certain wagering game machine.

In some embodiments, the awards of the particular type are redeemable for money.

In some embodiments, the awards of the particular type are redeemable for awards of another type.

In some embodiments, a method comprising determining awards associated with a player, wherein the awards the player acquired the awards for activities in a wagering game system, and wherein the awards are of a plurality of types; providing information indicating items for which the awards can be redeemed. The method can also include detecting a request to redeem one or more of the awards for one of the items; and performing the redemption.

In some embodiments, the items are selected from the group consisting of online services, awards of the plurality of types, merchandise, and goods.

In some embodiments, the activities include playing wagering games in a casino.

In some embodiments, some of the awards associated with the player have been assigned a cash value by the wagering game system.

In some embodiments, the items are selected from the group of wagering game features consisting of a free spin, a re-spin, a shield from a game terminating event, and a bonus round activator.

BRIEF DESCRIPTION OF THE FIGURES

Embodiments of the invention are illustrated in the Figures of the accompanying drawings in which.

DESCRIPTION OF THE EMBODIMENTS

This description of the embodiments is divided into five sections. The first section provides an introduction to embodiments of the invention, while the second section describes example wagering game machine architectures. The third section describes example operations performed by some embodiments and the fourth section describes example wagering game machines in more detail. The fifth section presents some general comments.

Introduction

This section provides an introduction to some features of a wagering game awards system.

Some wagering game environments are limited to wagering game machines on a casino floor. In those environments, the machines typically allow players to bet money on wagering games, such as video slots, video poker, video blackjack, etc. When players win, the machines payout money. Sometimes, in addition to money, the machines may award coupons, vouchers for goods or services, or virtual game pieces for use in subsequent wagering games. Thus, in many wagering game environments, players have limited game play and award options. However, some embodiments of the invention provide wagering game environments in which players can win and use awards in many ways. For example, in some embodiments, players can win awards for playing wagering games in casinos, participating in online activities, communicating with others online, providing content online, etc. Players can exchange the awards for money or they can use the awards in other ways. For example, players can use the awards to buy retail merchandise, wagering games, virtual products for use online, and other goods and services. Additionally, in some embodiments, members can "spend" the awards to gain higher status in the environment, where higher status avails players of more privileges, faster service, more online content, etc. The discussion of FIG. 1 describes a system for providing numerous award options.

Figure 1:
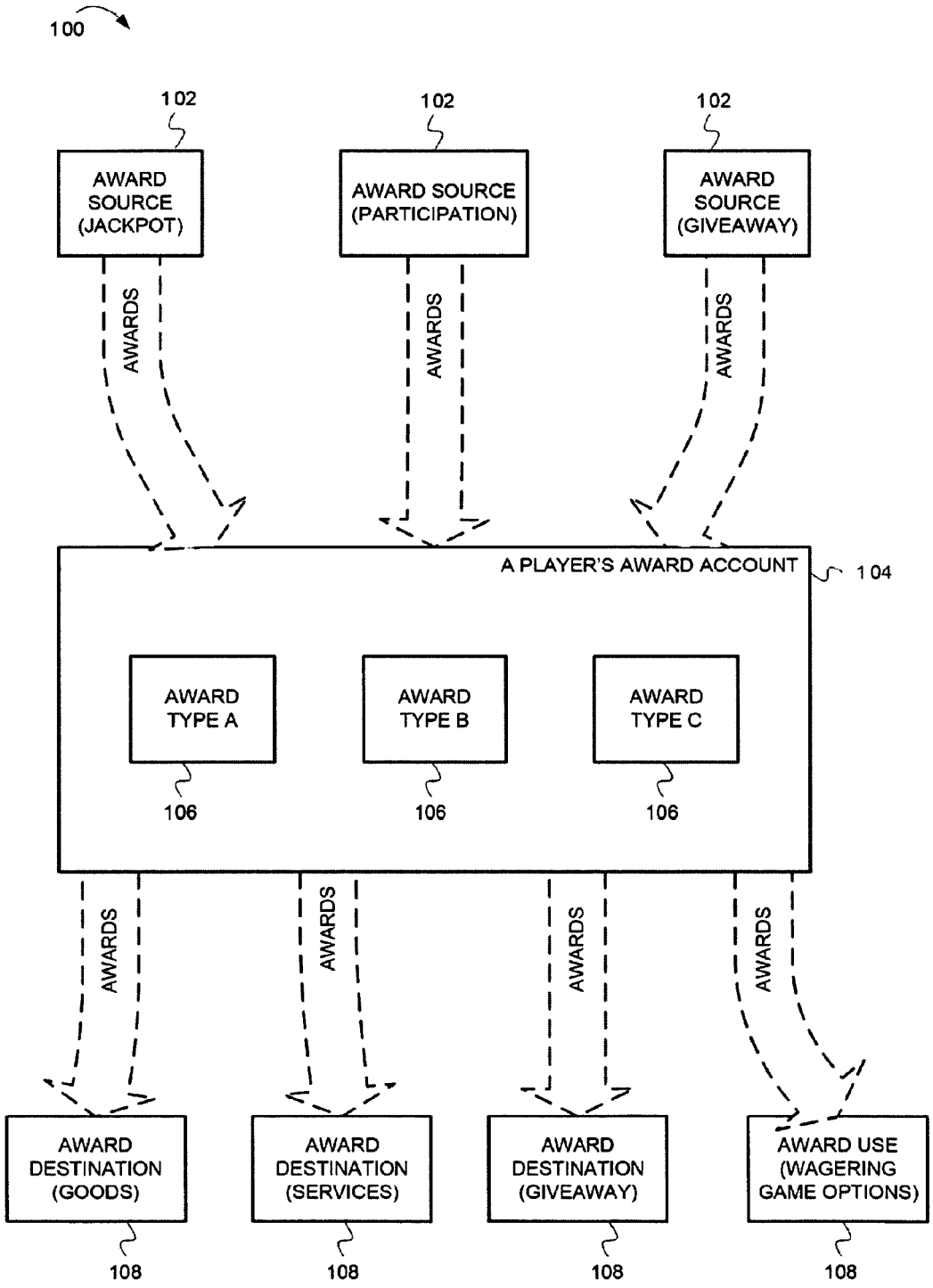
FIG. 1 is a dataflow diagram illustrating ways in which a player can acquire and use awards in a wagering game system, according to example embodiments of the invention.

FIG. 1 is a dataflow diagram illustrating ways in which a player can acquire and use awards in a wagering game system, according to example embodiments of the invention. In FIG. 1, the wagering game system 100 includes a plurality of award sources 102, a player's award account 104, and a plurality of award destinations 108.

The award sources 102 represent ways in which a player can acquire awards. For example, a player can acquire awards by winning jackpots on wagering game machines, by participating activities online (e.g., posting comments on a chat board), or by being the beneficiary of an award giveaway (e.g., as part of a promotion). As shown in FIG. 1, when a player acquires awards, the awards accumulate in an award account associated with the player (see player's award account 104). The awards can be of different types (see award types 106), where each type has a different value and different uses. The player's award account 104 can track how many awards of each type the player has accumulated.

The award destinations 108 represent ways in which the player can use the awards. As shown, the player can use awards to obtain retail merchandise, to obtain virtual services (e.g., ability to send instant messages from online to wagering game machines in casino), or to enable wagering game options (e.g., a free spin). The player can also give away awards to other members. As the player uses awards, the player's award account 104 is reduced appropriately.

Although FIG. 1 describes some embodiments, the following sections describe many other features and embodiments.

Example Awards Hierarchy

The section provides an example of how wagering game environments can support different award types. In some embodiments, a wagering game environment supports a number of award types, where the award types have different values, properties, and uses. For example, a wagering game environment could support three award types: Pointz, Coinz, and Voucherz.

The following subsections will describe Pointz, Coinz, and Voucherz in more detail. The subsections describes how players can acquire awards of a given type, how players can use awards of the type, and properties associated with awards of the type.

Pointz

In this example awards hierarchy, Pointz are the most flexible award type. Players can exchange Pointz for cash or awards of any type (i.e., Coinz and Voucherz). Wagering game system operators, marketers, and other entities can buy Pointz from a store associated with the wagering game environment. After the operators, marketers, and other entities buy Pointz, they can transfer the Pointz to players in many different ways.

Players can acquire Pointz by:

Participating in activities in a casino—e.g., casinos can award Pointz based on money spent at wagering game machines, time spent at the machines, machines played, etc.

Participating in activities online—e.g., contributing content online, clicking adds online, watching videos, playing games online, etc.

Receiving Pointz through random promotions—e.g., some third party marketers can randomly give away Pointz.

Purchasing Pointz for money.

Etc.

When players acquire Pointz, the Pointz are stored in award accounts associated with the players. As players accumulate Pointz, players can use Pointz by:

Redeeming Pointz for cash.

Redeeming Pointz for awards of other types (i.e., Coinz and Voucherz).

Using Pointz to place wagers on wagering game machines.

Redeeming Pointz to acquire online goods and services—e.g., players can use Pointz to acquire instant messaging services, faster downloads, game elements for online games, etc.

Using Pointz to make trades with other players—e.g., one player can trade Pointz for another player's Voucherz or Coinz.

Pointz can have certain properties. For example:

Pointz can expire over time.

Pointz can have "give away" status—i.e., a player must give the Pointz away to others players.

Coinz

Coinz are promotional awards that can affect wagering game play and returns. Coinz enable game features, such as extra spins, protection from game terminating events, payout multipliers, respins, etc. Different Coinz can have different values, so some Coinz may be able to enable certain game features, while others cannot.

Players can acquire Coinz by:

Redeeming Pointz for Coinz.

Trading Pointz or Voucherz for other player's Coinz.

Trading Coinz for Coinz.

Achieving certain outcomes in wagering games—e.g., having a royal flush in a video poker game, hitting blackjack in video blackjack, etc.

Achieving outcomes online—e.g., winning an online non-wagering game tournament.

Playing frequently in casinos.

Receiving random awards.

Joining an online group or league.

Etc.

When players acquire Coinz, the Coinz are stored in award accounts associated with the players. As players accumulate Coinz, players can use Coinz for:

Purchasing extra base game features—e.g., extra spins, respins, payout multipliers, etc.

Making extra bets or purchasing insurance.

Purchasing special bonus features—e.g., protection from game terminating events, an extra spin, etc.

Purchasing a bonus round.

Entering tournaments online or in casinos.

Etc.

Coinz can have certain properties. For example:

Coinz can have use restrictions—e.g., certain Coinz may work only with certain themes Coinz can have a value in Pointz. The value can be hidden from players.

Coinz can have hidden value.

Coinz can differ in appearance.

Coinz can be promotional.

Coinz can have an expiration date.

Coinz can have "given away" status, which requires that players give them away to others.

Coinz can have a secure serial number.

In addition to the foregoing features, Coinz can also be used in other ways. In particular, Coinz can be aggregated. For example, five copper Coinz can be redeemed for one silver Coinz, where the single silver Coinz is more valuable than the five copper Coinz. Additionally, Coinz can be sold separately or in mystery packs, which reveal their value only at wagering game machines.

Coinz can makeup sets. Players can collect sets of unusual Coinz to enable special games. The face value of these special Coinz is the same as any other, although their appearance is different. The frequency with which sets appear can be strictly controlled. In some instances, players can use a set only once. When a player collects a set of Coinz, the system tells the player that a special game is available. In some instances, the player can play the game online or at a wagering game machine. Funding for the special game can be kept separately from the other funds, or it may be part of a general award pool.

Some Coinz of a set may be rare. The system can make certain Coinz rare in several ways. For example, the system may issue Coinz based on a random table that makes some Coinz rare and some Coinz common. Alternatively, the system can keep a separate prize pool funded by marketing, coin-in, or other methods. Once that pool reaches a certain size, a rare Coinz is minted. Receiving a rare Coinz can be a mystery event, or an event that is partly triggered by the system and partly by the game play.

In some embodiments, the theoretical payback of an individual wagering game machine accounts for Coinz, where Theoretical Payback %=(coin-out+Coinz-out)/(coin-in+Coinz-in) In some embodiments, the gaming machine meters Coinz-in separately from regular coin-in, and Coinz-out separately from regular coin-out, and forms the total theoretical payback % based on all four.

Voucherz

Voucherz are coupons that can be redeemed for services and/or merchandise.

Players can acquire Voucherz by:

Participating in activities in a casino—e.g., casinos can award Voucherz based on money spent at wagering game machines, time spent at the machines, machines played, etc.

Participating in activities online—e.g., contributing content online, clicking on adds online, watching certain videos online, playing online games, etc.

Random promotions—e.g., some third party marketers can randomly give away Voucherz.

Purchasing Voucherz with money.

Trading with other players.

Etc.

When players acquire Voucherz, the Voucherz are stored in award accounts associated with the players. As players accumulate Voucherz, players can use Voucherz by:

Redeeming Voucherz to acquire online goods and services—e.g., players can use Pointz to acquire instant messaging services, faster downloads, game elements for online games, etc.

Trades with other players—e.g., one player can trade a Voucherz for online services for another player's Voucherz for golf green fees.

Voucherz can have certain properties. For example:

Voucherz can expire over time.

Voucherz can have "give away" status—i.e., a player must give the Voucherz away to others players.

Some Voucherz may be tradable, while others are not.

Voucherz can differ in appearance.

Voucherz can have a secure serial number.

Status

In addition to the options noted above, awards can also contribute to a player's status. In some embodiments, the number and type of awards a player accumulates can affect the player's status. For example, a player's status increases as they accumulate more Pointz in their player accounts. Players that achieve high status may have access to more online and casino services. High status players may also receive more promotional offers, have a better Coinz available, and potentially receive more awards from games. Additionally, high status player may get a greater number of awards (e.g., Pointz) in return for their play.

Funding

In some embodiments, entities must fund awards they distribute to players. For example, casinos and/or wagering game manufacturers pay money for Pointz that will be awarded for playing wagering game machines. Similarly, third party marketers pay money for Pointz they distribute for promotions. As players redeem Pointz, the monies are used to provide cash, goods, services, etc.

While this section describes example award types, other embodiments support different award types. In other embodiments, values, properties, and uses associated with each award type can be completely different.

Example Operating Environment

This section describes an example operating environment and provides structural aspects of some embodiments. This section includes discussion about wagering game networks, wagering game machine architectures, and award server architectures.

Wagering Game Networks

Figure 2:
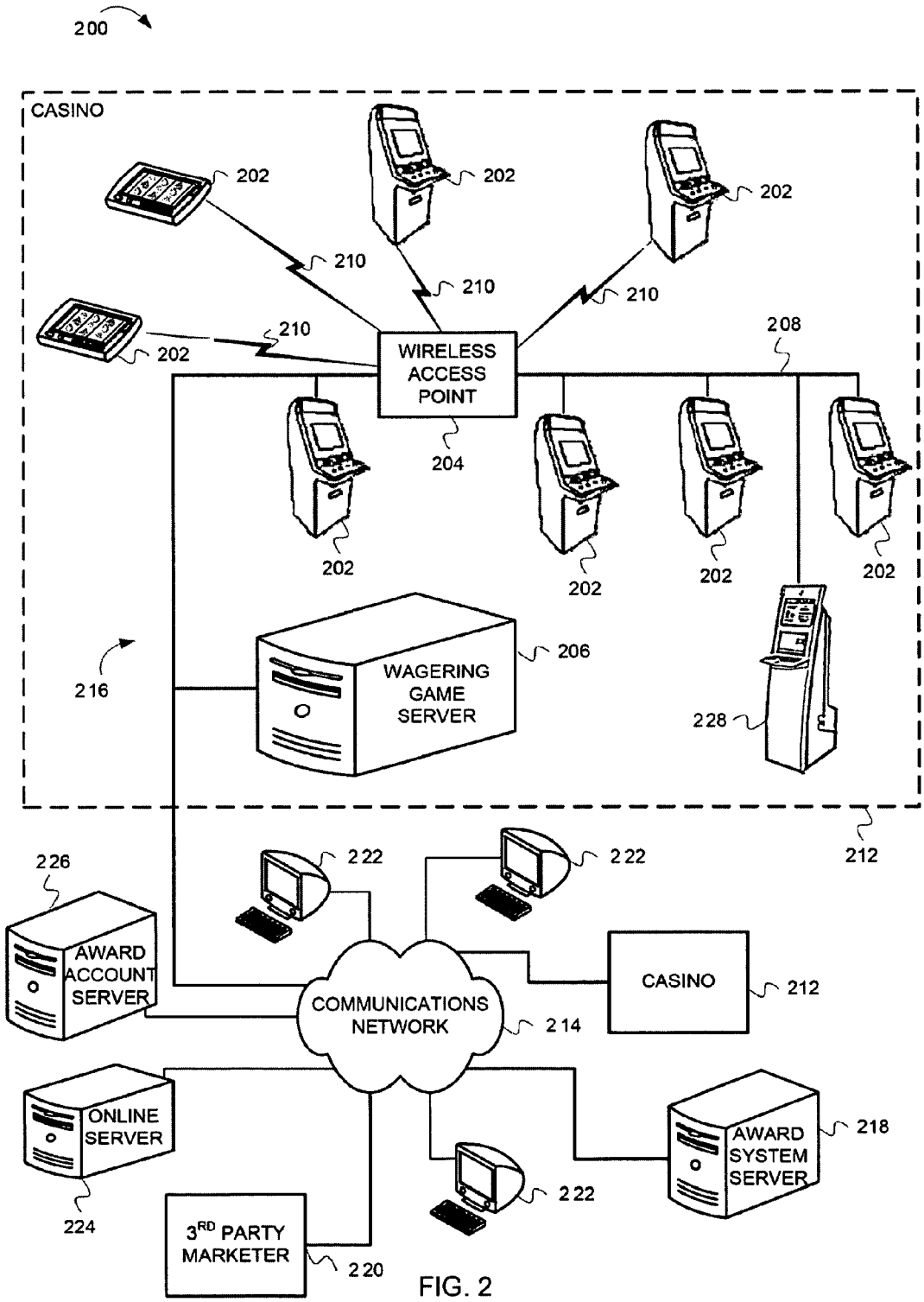
FIG. 2 is a block diagram illustrating a wagering game network 200, according to example embodiments of the invention.

FIG. 2 is a block diagram illustrating a wagering game network according to example embodiments of the invention. The wagering game network 200 can facilitate distribution, redemption, and use of wagering game awards (e.g., Pointz, Coinz, and Voucherz). As shown in FIG. 2, the wagering game network 200 includes a communications network 214 connected to an award system server 218, award account server 226, third party marketer computer 220, online server 224, online access terminals 222, and a plurality of casinos 212.

The award system server 218 can include logic for implementing a wagering game awards system, where the awards can be of different types. For example, in some embodiments, the award system server 218 can include logic for distributing, redeeming, trading, spending, and otherwise using awards. In some embodiments, the award system server 218 detects events that trigger award-related operations. For example, the award system server 218 may receive an indication that a player won a jackpot at a wagering game machine 202. In response, the award system server 218 may transfer Pointz from a casino's account to the player's award account. These and other operations associated with embodiments of an award system server are described in more detail below (see the Example Operations section).

The award account server 226 can maintain award accounts for players and other entities, such as casinos, wagering game manufacturers, third party marketers, etc. The award account server 226 can perform award account transactions in response to requests from the award system server 218. For example, the award system server 218 can request that the award account server 226 transfer awards (e.g., Pointz, Coinz, and Voucherz) between a third-party marketer account and player accounts. In response, the award account server 226 can perform the transfer. In some embodiments, the award account server 226 and the award system server 218 can be integrated into a single component.

The third-party marketer computer 220 includes logic for conducting award-related transactions with the award system server 218 and award account server 226. For example, the third-party marketer computer 220 can establish an award account with the award account server 226 and register award promotions with the award system server 218. In turn, the award system server 218 can distribute awards from the third-party's award account to player accounts (e.g., when players view promotional ads).

The online server 224 can provide a wide range of services. The online server 224 can facilitate interaction between players. In some embodiments, the online server 224 can enable players who are online to interact with each other and with players who are in the casinos 212. Also, the online sever 224 can host web sites, chat rooms, newsgroups, email, discussion boards or forums, instant messaging, and/or other electronic facilities. According to embodiments, entities can distribute awards to players for participating in any online activity. According to some embodiments, the online servers can enable players to:

- Create social networks—When creating social networks, players can create electronic associations that inform network members when selected players are: 1) online, 2) performing activities, 3) reaching milestones, 4) etc.
- Establish a reputation—Players can establish reputations based on feedback from other players, based on accomplishments in the casinos and online, based on who is in their social network, etc.
- Provide content—Players can provide content by uploading media, designing wagering games, maintaining blogs, etc.
- Filter Content—Players can filter content by rating content, commenting on content, or otherwise distinguishing content.
- Interact with other players—Players can interact via newsgroups, e-mail, discussion boards, instant messaging, etc.
- Participate in various online activities—Players can participate in online activities, such as multi-player games, interactive meetings, discussion groups, etc.

The terminals 222 enable players to access services available from the online server 224 and other network components. The terminals can include personal computers, workstations, personal digital assistants, or other computing devices. In some embodiments, the terminals 222 can wirelessly connect to the communications network 214.

Each casino 212 includes a local area network 216, which includes an access point 204, a wagering game server 206, kiosk 228, and wagering game machines 202. The access point 204 provides wireless communication links 210 and wired communication links 208. The wired and wireless communication links can employ any suitable connection technology, such as Bluetooth, 802.11, Ethernet, public switched telephone networks, SONET, etc. In some embodiments, the wagering game server 206 can serve wagering games and distribute content to devices located in other casinos 212 or at other locations on the communications network 214. The kiosk 228 can provide an interface for acquiring and using awards.

The wagering game machines 202 described herein can take any suitable form, such as floor standing models, handheld mobile units, bartop models, workstation-type console models, etc. Further, the wagering game machines 202 can be primarily dedicated for use in conducting wagering games, or can include non-dedicated devices, such as mobile phones, personal digital assistants, personal computers, etc. In one embodiment, the wagering game network 200 can include other network devices, such as accounting servers, wide area progressive servers, player tracking servers, and/or other devices suitable for use in connection with embodiments of the invention.

In some embodiments, wagering game machines 202 and wagering game servers 206 work together such that a wagering game machine 202 can be operated as a thin, thick, or intermediate client. For example, one or more elements of game play may be controlled by the wagering game machine 202 (client) or the wagering game server 206 (server). Game play elements can include executable game code, lookup tables, configuration files, game outcome, audio or visual representations of the game, game assets or the like. In a thin-client example, the wagering game server 206 can perform functions such as determining game outcome or managing assets, while the wagering game machine 202 can present a graphical representation of such outcome or asset modification to the user (e.g., player). In a thick-client example, the wagering game machines 202 can determine game outcomes and communicate the outcomes to the wagering game server 206 for recording or managing a player's account.

In some embodiments, either the wagering game machines 202 (client) or the wagering game server 206 can provide functionality that is not directly related to game play. For example, account transactions and account rules may be managed centrally (e.g., by the wagering game server 206) or locally (e.g., by the wagering game machine 202). Other functionality not directly related to game play may include power management, presentation of advertising, software or firmware updates, system quality or security checks, etc.

Any of the wagering game network components (e.g., the wagering game machines 202) can include hardware and machine-readable media including instructions for performing the operations described herein.

Wagering Game Machine Architectures

Figure 3:
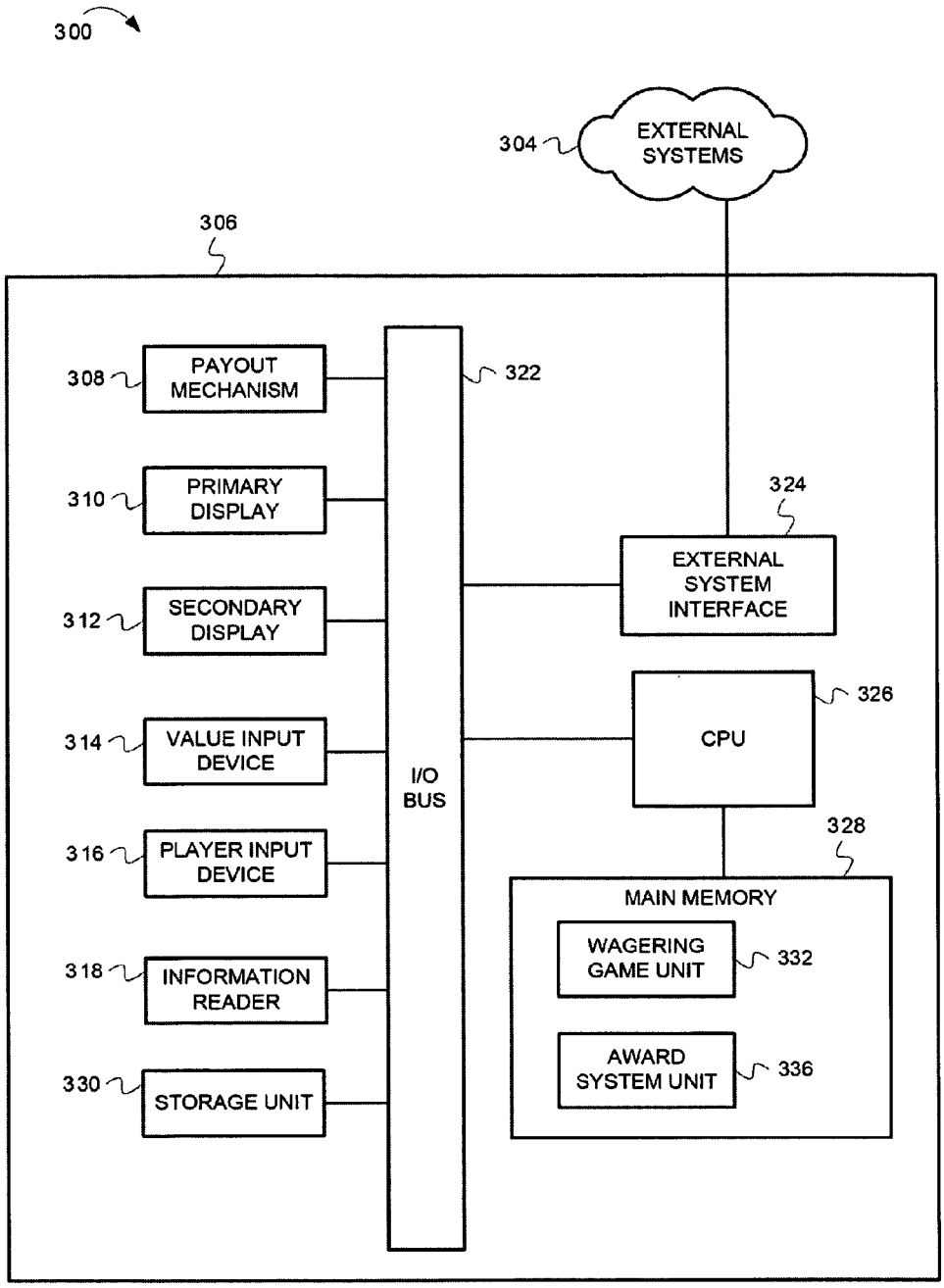
FIG. 3 is a block diagram illustrating a wagering game machine architecture, according to example embodiments of the invention.

FIG. 3 is a block diagram illustrating a wagering game machine architecture, according to example embodiments of the invention. As shown in FIG. 3, the wagering game machine architecture 300 includes a wagering game machine 306, which includes a central processing unit (CPU) 326 connected to main memory 328. The CPU 326 can include any suitable processor, such as an Intel® Pentium processor, Intel® Core 2 Duo processor, AMD Opteron™ processor, or UltraSPARC processor.

The main memory 328 includes a wagering game unit 332 and an award system unit 336. In some embodiments, the wagering game unit 332 can present wagering games, such as video poker, video blackjack, video slots, video lottery, etc., in whole or part.

In different embodiments, the award system unit 336 can have different functionality. In some embodiments, the award system unit 336 includes logic for detecting award events, determining award transactions, and reporting the award transactions to an award system server. In these embodiments, the award system unit 336 can receive a list indicating events that cause awards to be distributed and used (i.e., award transactions). Using the list, the award system unit 336 can keep track of events and determine how many awards should be added or subtracted from accounts associated with the events (e.g., player award accounts & casino award accounts). At the end of gaming session (or periodically or after each event), the award system unit 336 can request that the award system server 218 and/or the award account server 226 perform the award transactions. In other embodiments, the award system unit 336 has less functionality. For example, the award system unit 336 may record events to a data store accessible to the award system server 218, while the award system server 218 determines which events cause award transactions. In some embodiments, the award system unit 336 can present results of award transactions.

The CPU 326 is also connected to an input/output (I/O) bus 322, which can include any suitable bus technologies, such as an AGTL+ frontside bus and a PCI backside bus. The I/O bus 322 is connected to a payout mechanism 308, primary display 310, secondary display 312, value input device 314, player input device 316, information reader 318, and storage unit 340. The player input device 316 can include the value input device 314 to the extent the player input device 316 is used to place wagers. The I/O bus 322 is also connected to an external system interface 324, which is connected to external systems 304 (e.g., wagering game networks).

In one embodiment, the wagering game machine 306 can include additional peripheral devices and/or more than one of each component shown in FIG. 3. For example, in one embodiment, the wagering game machine 306 can include multiple external system interfaces 324 and/or multiple CPUs 326. In one embodiment, any of the components can be integrated or subdivided.

Any component of the architecture 300 can include hardware, firmware, and/or machine-readable media including instructions for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

While FIG. 3 describes an example wagering game machine architecture, this section continues with a discussion of award system servers.

Award Servers

Figure 4:
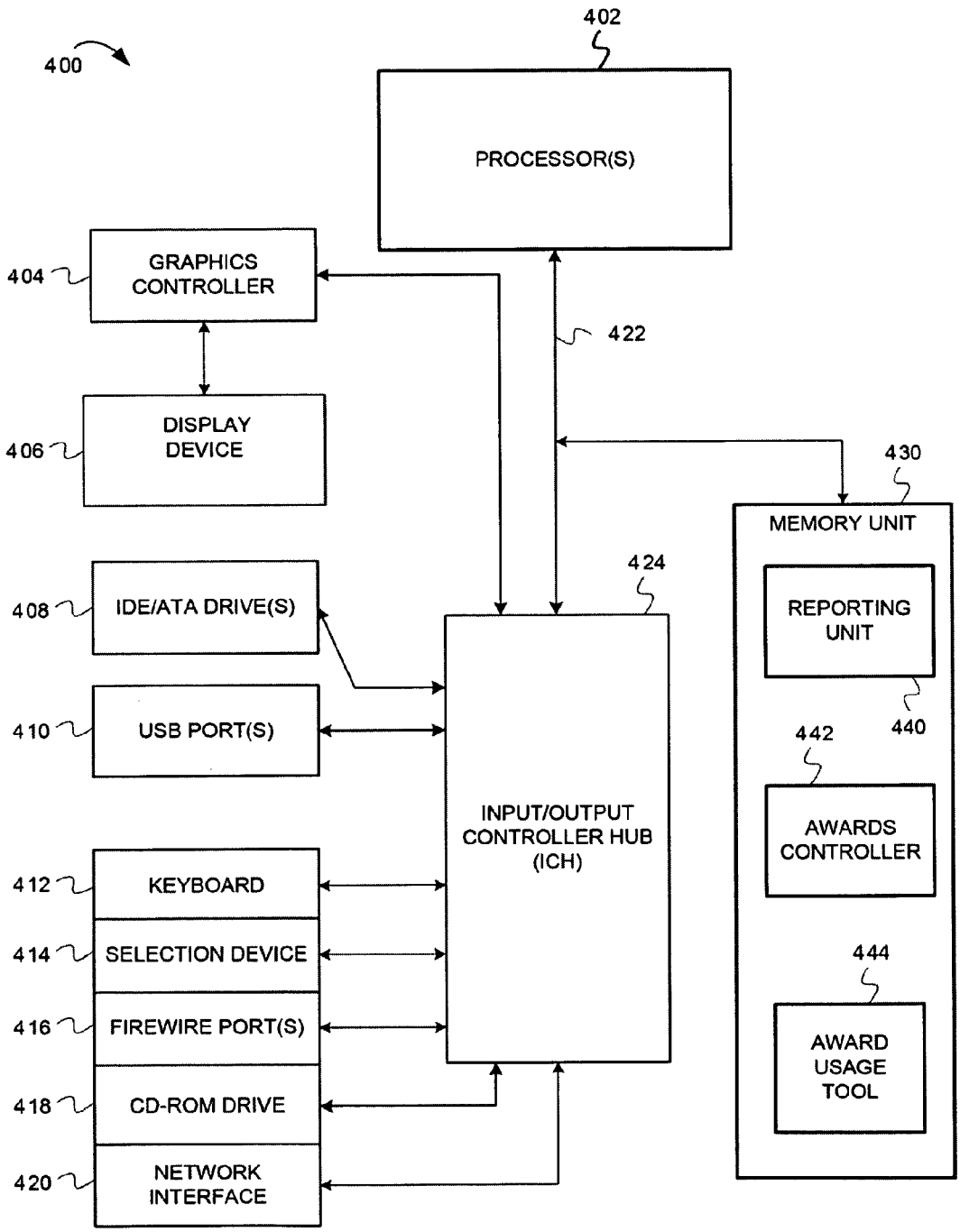
FIG. 4 is a block diagram illustrating an example award server architecture, according to example embodiments of the invention.

FIG. 4 is a block diagram illustrating an example award system server architecture, according to example embodiments of the invention. As illustrated in FIG. 4, the award system server 400 comprises a processor 402. The award system server 400 also includes a memory unit 430, processor bus 422, and input/output controller hub (ICH) 424. The processor 402, memory unit 430, and ICH 424 are coupled to the processor bus 422. The processor 402 may comprise any suitable processor architecture. The award system server 400 may comprise one, two, three, or more processors, any of which may execute a set of instructions in accordance with embodiments of the present invention.

The memory unit 430 includes an awards controller 442, reporting unit 440, and award usage tool 444. In some embodiments, the awards controller 442 can directly or indirectly monitor activities occurring in a wagering game system. Based on the activities, the awards controller 442 can determine that awards should be acquired and used. In some embodiments, the awards controller 442 can instruct an award account server to update award accounts based on the award acquisitions and uses. In some embodiments, the reporting unit 440 notifies players (at wagering game machines, terminals, or kiosks) about results of award account transactions.

For example, the reporting unit 440 can notify a player that ten Pointz have been added to the player's award account.

In some embodiments, the award usage tool 444 assists players in using their awards. For example, the award usage tool 444 can present a user interface that suggests redemption items that are affordable to a given player. In some embodiments, the award usage tool 444 can use past buying habits, popular award usage trends, and other information to suggest redemption or trade options. Additionally, the award usage tool 444 can use past trading habits, popular award trading trends, and other information to suggest interesting player-to-player award trades. In some embodiments, players must be registered with the award system server 218 to use the award usage tool 444. In other embodiments, any player can use it. However, non-registered players would have to redeem their awards before ending a gaming session because non-registered players are not associated with award accounts. In some embodiments, players can query the tool 444 to find out what activities will lead to certain award types, such as rare Coinz. Operations of some embodiments of an award system server are discussed below (see the Example Operations section).

The memory unit 430 can store data and/or instructions, and may comprise any suitable memory, such as a dynamic random access memory (DRAM), for example. The award system server 400 also includes IDE drive(s) 408 and/or other suitable storage devices. A graphics controller 404 controls the display of information on a display device 406, according to embodiments of the invention.

The input/output controller hub (ICH) 424 provides an interface to I/O devices or peripheral components for the award system server 400. The ICH 424 may comprise any suitable interface controller to provide for any suitable communication link to the processor 402, memory unit 430 and/or to any suitable device or component in communication with the ICH 424. For one embodiment of the invention, the ICH 424 provides suitable arbitration and buffering for each interface.

For one embodiment of the invention, the ICH 424 provides an interface to one or more suitable integrated drive electronics (IDE) drives 408, such as a hard disk drive (HDD) or compact disc read only memory (CD ROM) drive, or to suitable universal serial bus (USB) devices through one or more USB ports 410. For one embodiment, the ICH 424 also provides an interface to a keyboard 412, a mouse 414, a CD-ROM drive 418, one or more suitable devices through one or more firewire ports 416. For one embodiment of the invention, the ICH 424 also provides a network interface 430 though which the award server 400 can communicate with other computers and/or devices.

In one embodiment, the award server 400 includes a machine-readable medium that stores a set of instructions (e.g., software) embodying any one, or all, of the methodologies for a wagering game system award economy. Furthermore, software can reside, completely or at least partially, within memory unit 430 and/or within the processor 402.

Example Operations

This section describes operations associated with some embodiments of the invention. In the discussion below, the flow diagrams will be described with reference to the block diagrams presented above. In certain embodiments, the operations are performed by executing instructions residing on machine-readable media (e.g., software), while in other embodiments, the operations are performed by hardware and/or other logic (e.g., firmware). In some embodiments, the operations are performed in series, while in other embodiments, one or more of the operations can be performed in parallel. This section continues with a discussion of how players can acquire awards in a wagering game environment.

Figure 5:
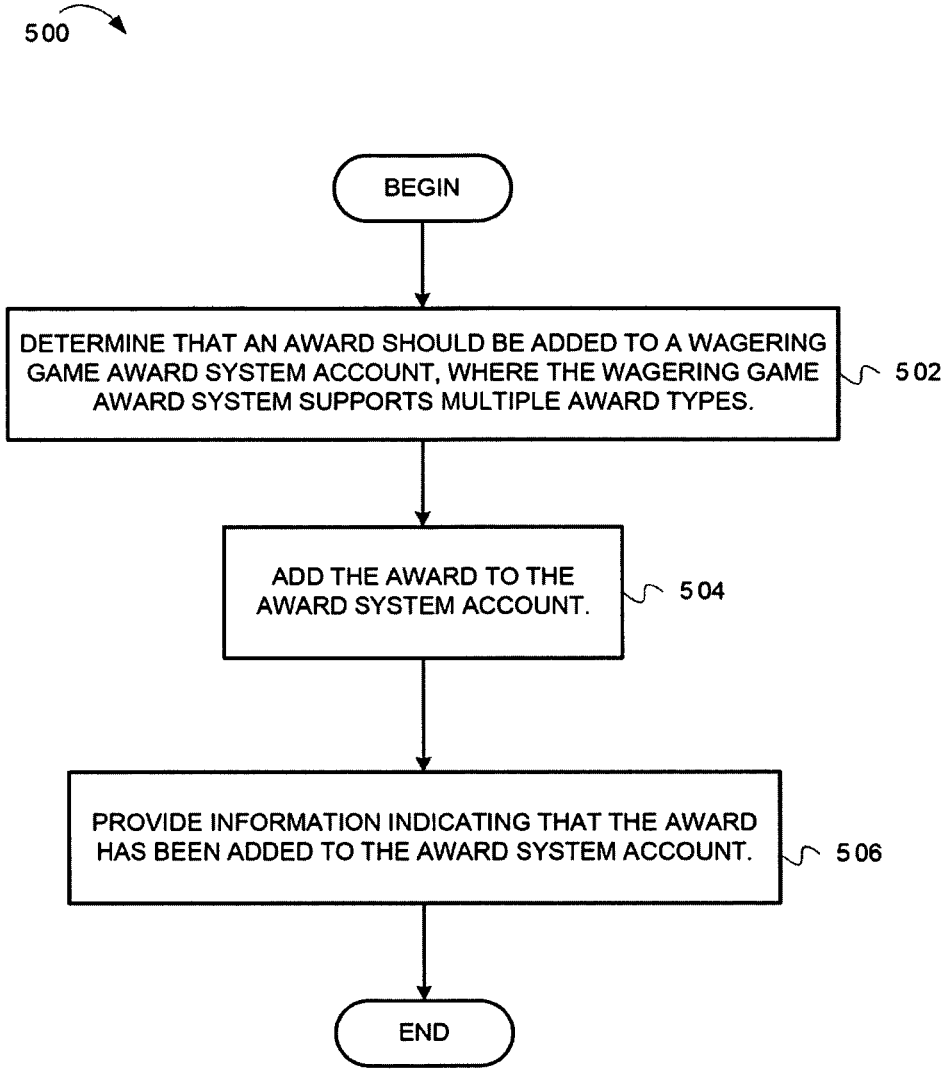
FIG. 5 is a flow diagram illustrating operations for adding awards to a wagering game award system account, according to example embodiments of the invention.

FIG. 5 is a flow diagram illustrating operations for adding awards to a wagering game award system account, according to example embodiments of the invention. The flow begins at block 502.

At block 502, an award system server 218 determines that an award should be added to a wagering game award system account, where the wagering game award system supports multiple award types. In some embodiments, the award system server's awards controller 442 makes this determination based on player activities. The player activities can include online activities and casino activities. For example, the player activities can include depositing money into wagering game machines, winning jackpots on wagering game machines, accessing promotional materials online, filtering content online, etc. The flow continues at block 504.

At block 504, the award system server 218 adds the award to a player's award account. In some embodiments, the award system server's awards controller 442 instructs the award account server 226 to a particular type of award (e.g., a Voucherz) to the player's award account. The flow continues at block 506.

At block 506, the award system server 218 provides information indicating that the award has been added to the award system account. In some embodiments, the award server's reporting unit 440 notifies a player at a wagering game machine 202, kiosk 228, or terminal 222. From block 506, the flow ends.

Figure 6:
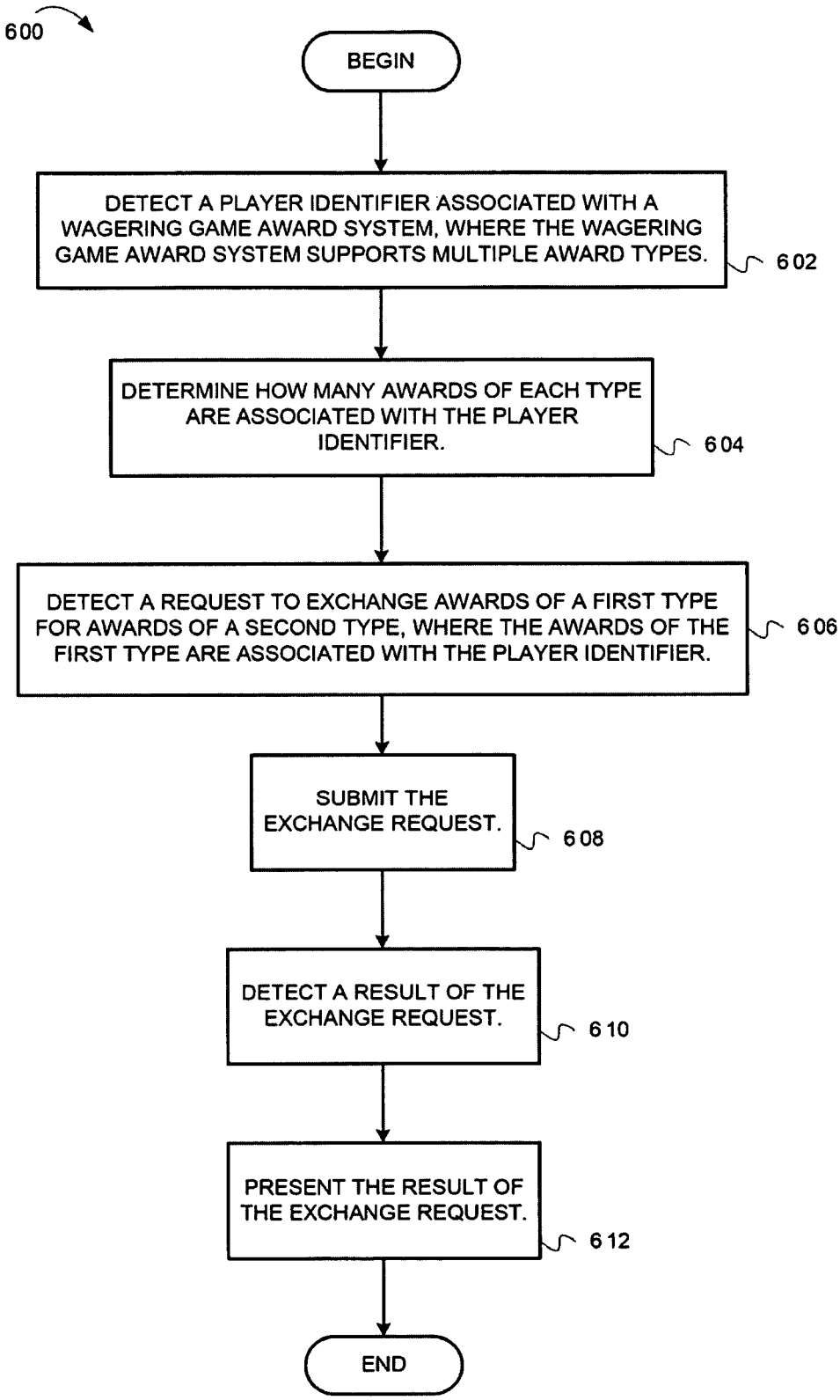
FIG. 6 is a flow diagram illustrating operations for exchanging one type of award for another type of award, according to example embodiments of the invention.
Figure 7:
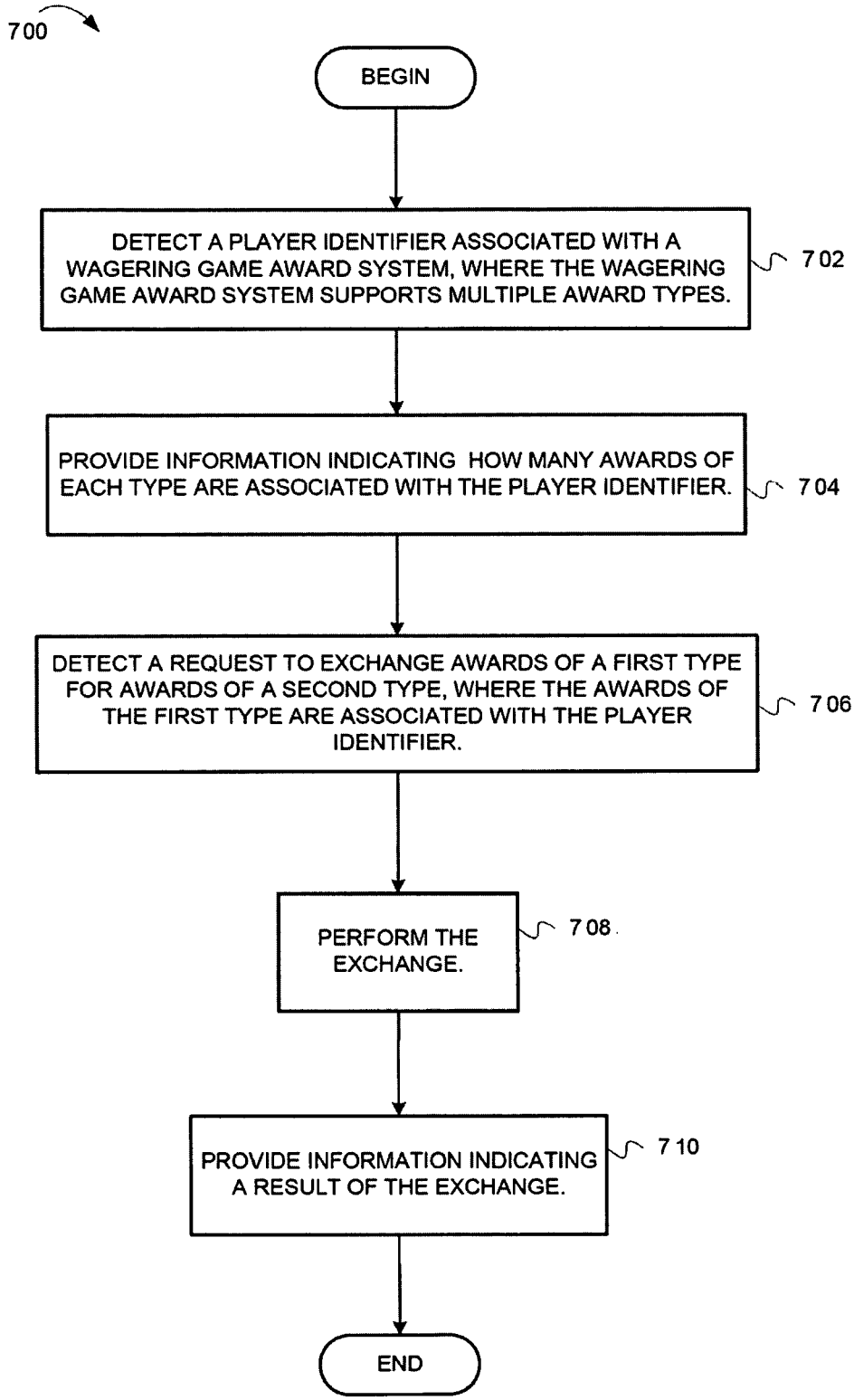
FIG. 7 is a flow diagram illustrating operations for facilitating exchanging one type of award for another type of award, according to example embodiments of the invention.

This section continues with a discussion of operations for redeeming awards of one type for awards of another type. FIGS. 6 & 7 describe these operations.

FIG. 6 is a flow diagram illustrating operations for exchanging one type of award for another type of award, according to example embodiments of the invention. The flow begins at block 602.

At block 602, a wagering game machine 202 detects a player identifier associated with a wagering game award system, where the wagering game award system supports multiple award types. The flow continues at block 604.

At block 604, the wagering game machine 202 determines how many awards of each type are associated with the player identifier. For example, the wagering game machine's award system unit 336 queries the award system server 218 for an award account balance associated with the player identifier. The award account balance can include awards of different types, such as Pointz, Coinz, and Voucherz. The flow continues at block 606.

At block 606, the wagering game machine 202 detects a request to exchange awards of a first type for awards of a second type, where the awards of the first type are associated with the player identifier. In some embodiments, the exchange can be between players (e.g., one player wants to exchange Pointz for another player's Coinz). In some embodiments, the exchange can be between a player and the awards system (i.e., entities—retailers, casinos, etc.—who are transparent to players but who facilitate award exchange and redemption). As an example, requested exchange can be a player's Pointz for a Coinz award available from the award system (e.g., from a casino). The flow continues at block 608.

At block 608, the wagering game machine 202 submits the exchange request. In one embodiment, the wagering game machine 202 submits the exchange to the award system server 218. The flow continues at block 610.

At block 610, the wagering game machine 202 detects a result of the exchange request. In one embodiment, the result indicates that the award system server 218 successfully processed the exchange request. The flow continues at block 612.

At block 612, the wagering game machine 202 presents the result of the exchange request. For example, the wagering game machine's award system unit 336 presents graphical content indicating an updated balance of the player's award account. From block 612, the flow ends.

While the FIG. 6 describes an award exchange from the perspective of a wagering game machine, other wagering game network devices (e.g., a kiosk 228, terminal 222, etc.) can perform the flow 600. FIG. 7 describes how other network devices (e.g., the award system server 218) help facilitate award exchanges.

FIG. 7 is a flow diagram illustrating operations for facilitating exchanging one type of award for another type of award, according to example embodiments of the invention. The flow begins at block 702.

At block 702, the award system server 218 detects a player identifier associated with a wagering game award system, where the wagering game award system supports multiple award types. In one embodiment, the award system server's awards controller 442 receives the player identifier from a wagering game machine 202 or kiosk 228. The flow continues at block 704.

At block 704, the award system server 218 provides information indicating how many awards of each type are associated with the player identifier. In some embodiments, the award system server's awards controller 442 transmits the information to a wagering game machine 202 or kiosk 228. The flow continues at block 706.

At block 706, the award system server 218 detects a request to exchange awards of a first type for awards of a second type, where the awards of the first type are associated with the player identifier. In some embodiments, the exchange can be between players (e.g., one player wants to exchange Pointz for another player's Coinz). In some embodiments, the exchange can be between a player and the awards system (i.e., entities—retailers, casinos, etc.—who are transparent to players but who facilitate award exchange and redemption). As an example, requested exchange can be a player's Pointz for a Coinz award available from the award system (e.g., from a casino's account). The flow continues at block 708.

At block 708, the award system server 218 performs the exchange. In one embodiment, the awards controller 442 instructs the award account server 226 to subtract Pointz and add the particular Coinz. The flow continues at block 710.

At block 710, the award system server 218 provides information indicating a result of the exchange. In some embodiments, the award system server's reporting unit 440 notifies the player (e.g., via instant message, e-mail, graphics presentable in a user interface, etc.) that the exchange was successful. From block 710, the flow ends.

This section continues with a discussion of operations for spending awards in a wagering game environment.

Figure 8:
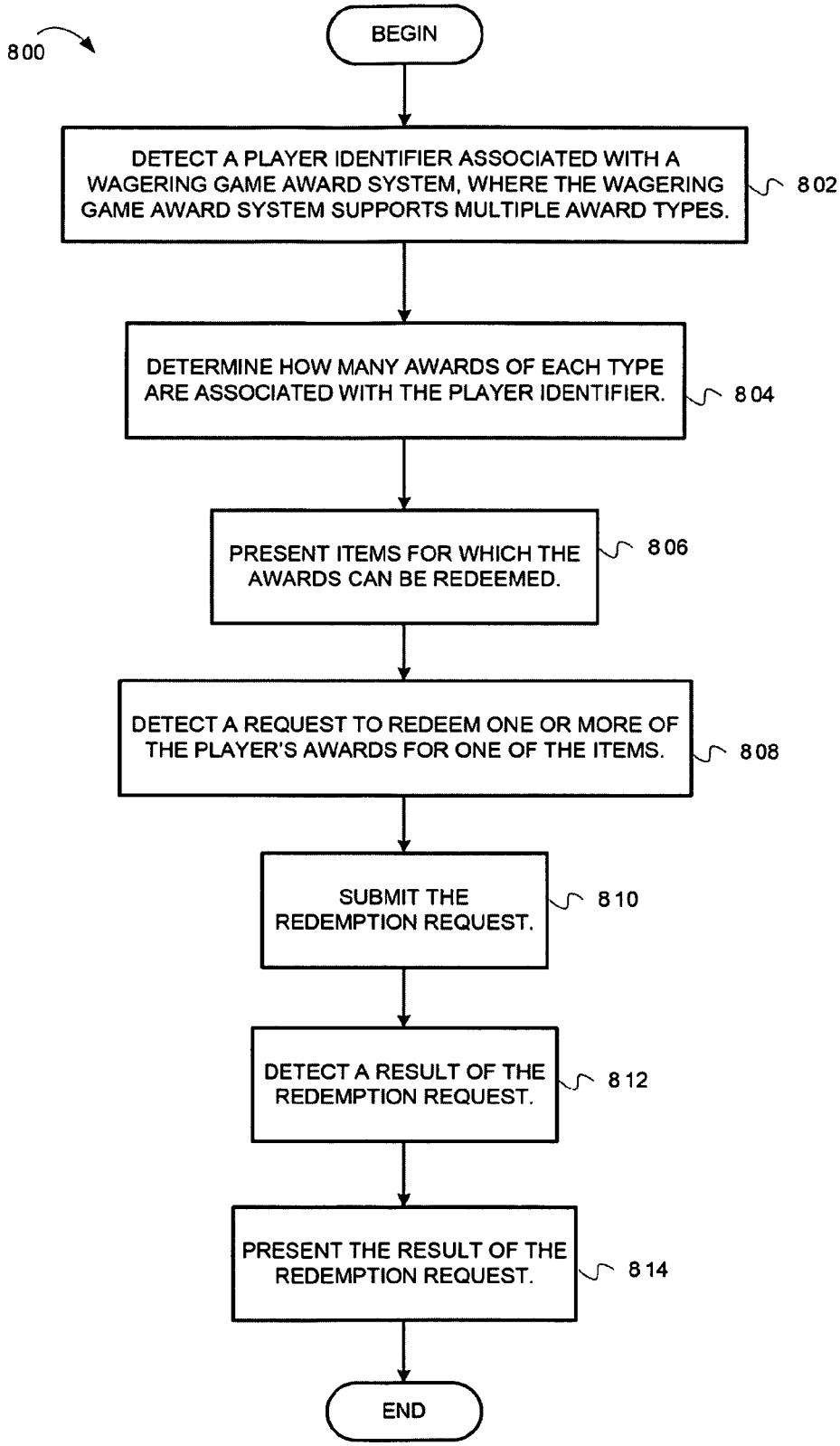
FIG. 8 is a flow diagram illustrating operations for spending awards, according to example embodiments of the invention.

FIG. 8 is a flow diagram illustrating operations for spending awards, according to example embodiments of the invention. The flow begins at block 802.

At block 802, a wagering game machine 202 detects a player identifier associated with a wagering game award system, where the wagering game award system supports multiple award types. In some embodiments, the wagering game machine's information reader 318 reads a player identifier from a player tracking card. The flow continues at block 804.

At block 804, the wagering game machine 202 determines how many awards of each type are associated with the player identifier. In some embodiments, the wagering game machine's award system unit 336 queries the award system server 218 or award account server 226 for an award account balance associated with the player identifier. The award account balance can include awards of different types, such as Pointz, Coinz, and Voucherz. The flow continues at block 806.

At block 806, the wagering game machine 202 presents items for which the awards can be redeemed. For example, the award system unit 336 presents a list of retail merchandise, awards (Coinz and Voucherz), services, etc. The flow continues at block 808.

At block 808, the wagering game machine 202 detects a request to redeem one or more of the player's awards for one of the items. For example, the wagering game machine 202 detects request to redeem Pointz for a shirt. Alternatively, the request can be to redeem Pointz for online services, casino services, etc. The flow continues at block 810.

At block 810, the wagering game machine 202 submits the redemption request. In one embodiment, the wagering game machine 202 submits the redemption request to the award system server 218. The flow continues at block 812.

At block 812, the wagering game machine 202 detects a result of the redemption request. In one embodiment, the wagering game machine 202 receives the result from the award system server 218. The result can indicate that the award system server 218 successfully processed the exchange request. The flow continues at block 814.

At block 814, the wagering game machine 202 presents the result of the redemption request. In some embodiments, the wagering game machine 202 can present the result of the redemption request by showing a game asset, available for use the wagering game, an updated award account balance, or other graphical content indicating the redemption results. From block 814 the flow ends.

Figure 9:
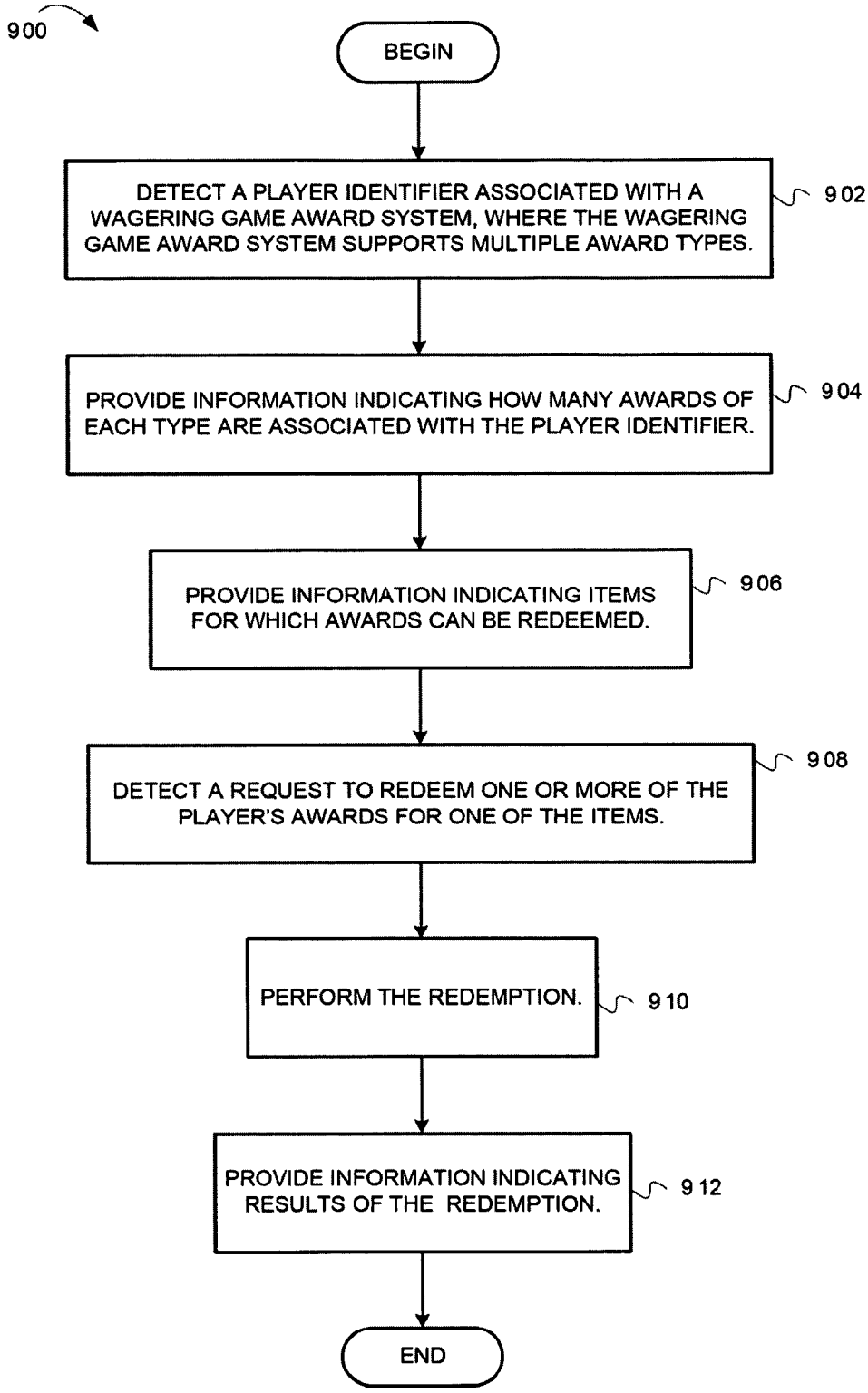
FIG. 9 is a flow diagram illustrating operations for facilitating spending awards, according to example embodiments of the invention.

While FIG. 8 describes operations typically performed by wagering game machines and kiosks, FIG. 9 describes operations typically performed by an award system server 218.

FIG. 9 is a flow diagram illustrating operations for facilitating spending awards, according to example embodiments of the invention. The flow begins at block 902.

At block 902, an award system server 218 detects a player identifier associated with a wagering game award system, where the wagering game award system supports multiple award types. In one embodiment, the award system server's awards controller 442 receives the player identifier from a wagering game machine 202 or kiosk 228. The flow continues at block 904.

At block 904, the award system server 218 provides information indicating how many awards of each type are associated with the player identifier. In some embodiments, the award system server's awards controller 442 transmits the information to a wagering game machine 202 or kiosk 228. The flow continues at block 906.

At block 906, the award system server 218 provides information indicating items for which awards can be redeemed. In some embodiments, the award server includes a list of goods, services, and other items of value that can be redeemed for awards. The award server 218 can transmit this list to a wagering game machine 202 or kiosk 228. The flow continues at block 908.

At block 908, the award system server 218 detects a request to redeem one or more of the player's awards for one of the items. The items can include any of the goods and services described herein. The flow continues at block 910.

At block 910, the award system server 218 performs the redemption. In some embodiments, the award server's awards controller 442 directs the award account server 226 to adjust the player's award account based on the redemption. The flow continues at block 912.

At block 912, the award system server 218 provides information indicating results of the redemption. From block 912, the flow ends.

This section continues with a description of how entities purchase and distribute awards.

Figure 10:
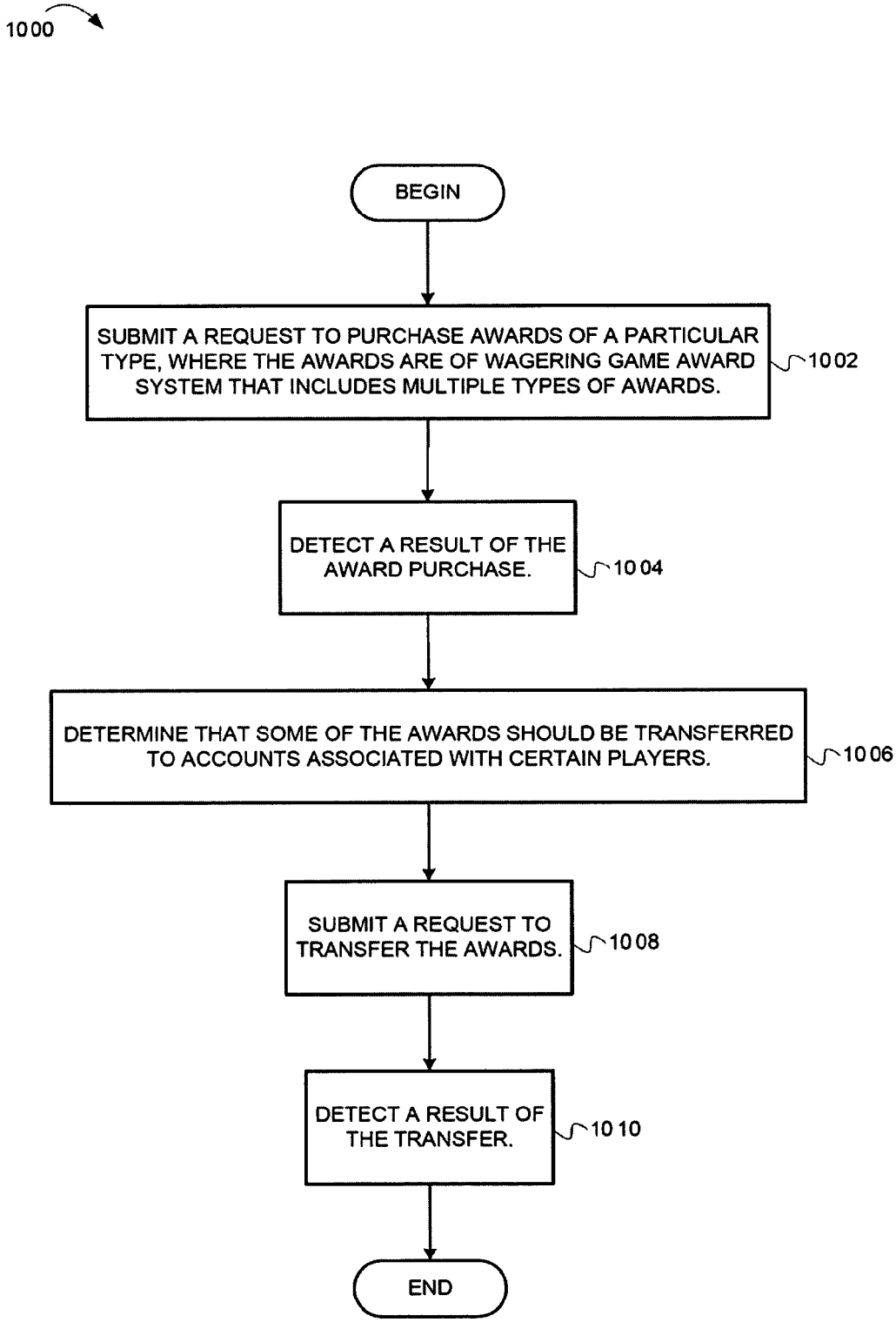
FIG. 10 is a flow diagram illustrating operations for facilitating spending awards, according to example embodiments of the invention.

FIG. 10 is a flow diagram illustrating operations for purchasing and distributing awards, according to example embodiments of the invention. The flow begins at block 1002.

At block 1002, a third party marketer 220 submits a request to purchase awards in a wagering game award system that includes multiple types of awards. The awards can be of different types. In some embodiments, the third party marketer 220 submits the request to the award system server 218. The flow continues at block 1004.

At block 1004, the third party marketer 220 detects a result of the award purchase. In some embodiments, the third party marketer 220 receives notification from the award system server 218 that the award purchase was successful. In some embodiments, the purchase adds awards (e.g., Pointz, Coinz, and Voucherz) to an account associated with the third party marketer 220, where the account resides in the award account server 226. The flow continues at block 1006.

At block 1006, the third party marketer 220 determines that some of the awards should be transferred to accounts associated with certain players. For example, the third party marketer 220 runs a promotion in which it distributes awards for specified online and casino activities. In some embodiments, The flow continues at block 1008.

At block 1008, the third party marketer 220 submits a request to transfer the awards. In some embodiments, the third party marketer 220 requests that the award system server 218 distribute awards upon detection of certain activities. For example, the third party marketer 220 may want the award system server 218 to distribute awards when players view certain advertisements on wagering game machines 202. The flow continues at block 1010.

At block 1010, the third party marketer 220 detects a result of the transfer. For example, the third party marketer 220 receives notifications when awards are distributed. From block 1010 the flow ends.

Figure 11:
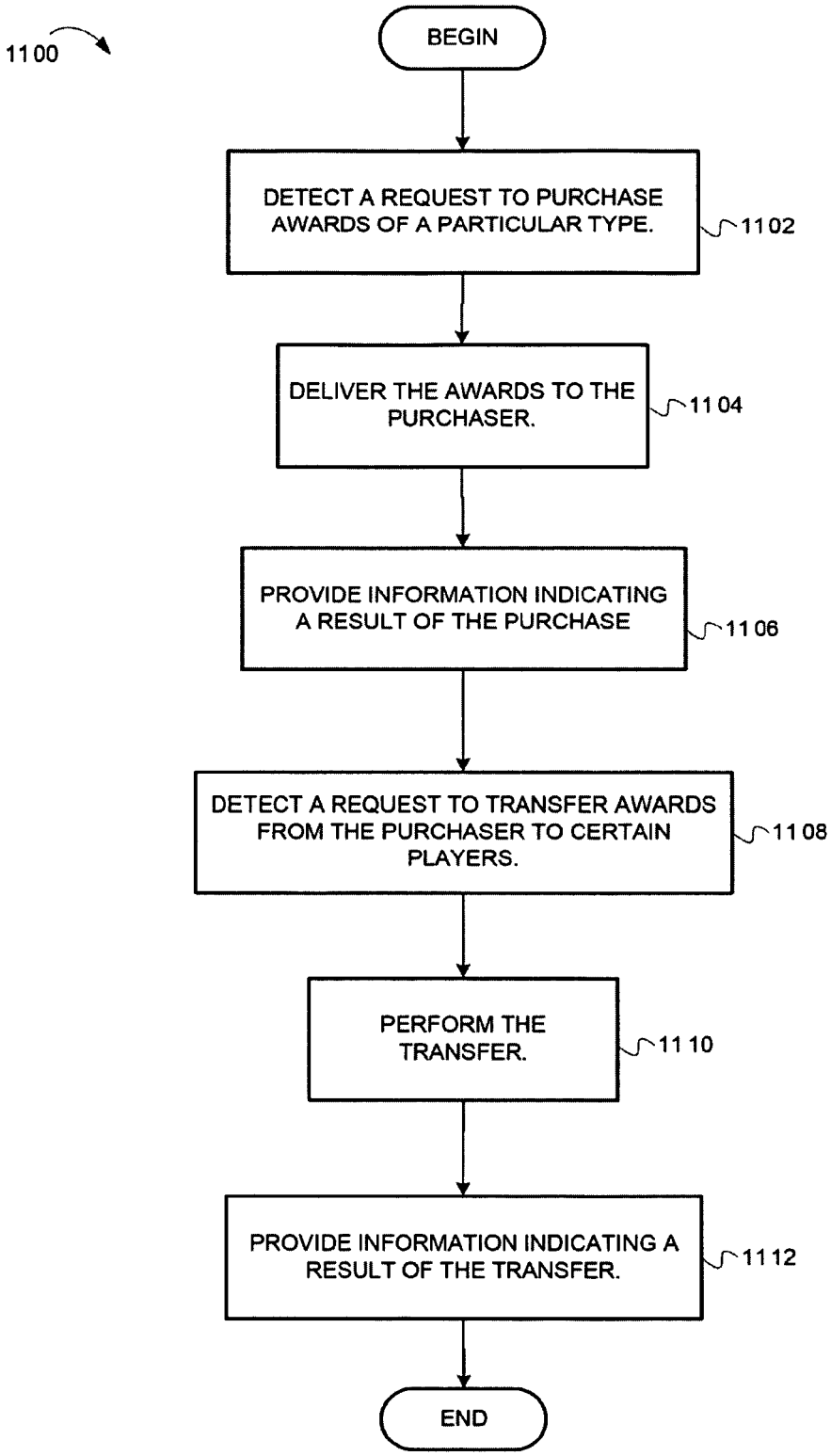
FIG. 11 is a flow diagram illustrating operations for spending awards, according to example embodiments of the invention.

While FIG. 10 describes purchase and distribution operations typically performed by third party marketers and other entities, while FIG. 11 describes purchase and distribution operations typically performed by embodiments of the award system server.

FIG. 11 is a flow diagram illustrating operations for selling and distributing, according to example embodiments of the invention. The flow begins at block 1102.

At block 1102, an award system server 218 detects a request to purchase awards of a particular type. The request can be from the third party marketer computer 220 or other entities wanting to purchase and distribute different types of awards. The flow continues at block 1104.

At block 1104, the award system server 218 delivers the awards to the purchaser. In some embodiments, the award system server 218 requests that the award account server 226 add awards (e.g., Pointz, Coinz, and Voucherz) to an account associated with the purchaser (e.g., the third party marketer). The flow continues at block 1106.

At block 1106, the award system server 218 provides information indicating a result of the purchase. In some embodiments, the award system server's reporting unit 440 informs the third party computer 220 of its new award account balance. The flow continues at block 1108.

At block 1108, the award system server 218 detects a request to transfer awards from the purchaser to certain users. In some embodiments, the third party marketer 220 requests that the award system server 218 distribute awards upon detection of specified activities. The flow continues at block 1110.

At block 1110, the award system server 218 performs the transfer. In some embodiments, the award system server 218 detects the specified activities (e.g., online players accessing advertisements, player certain wagering game machines, etc.) and transfers awards (e.g., Pointz and Coinz) into player accounts. The flow continues at block 1112.

At block 1112, the award system server 218 provides information indicating a result of the transfer. In some embodiments, the award system server 218 notifies the third party marketer and players about their updated award account balances. From block 1112, the flow ends.

Figure 12:
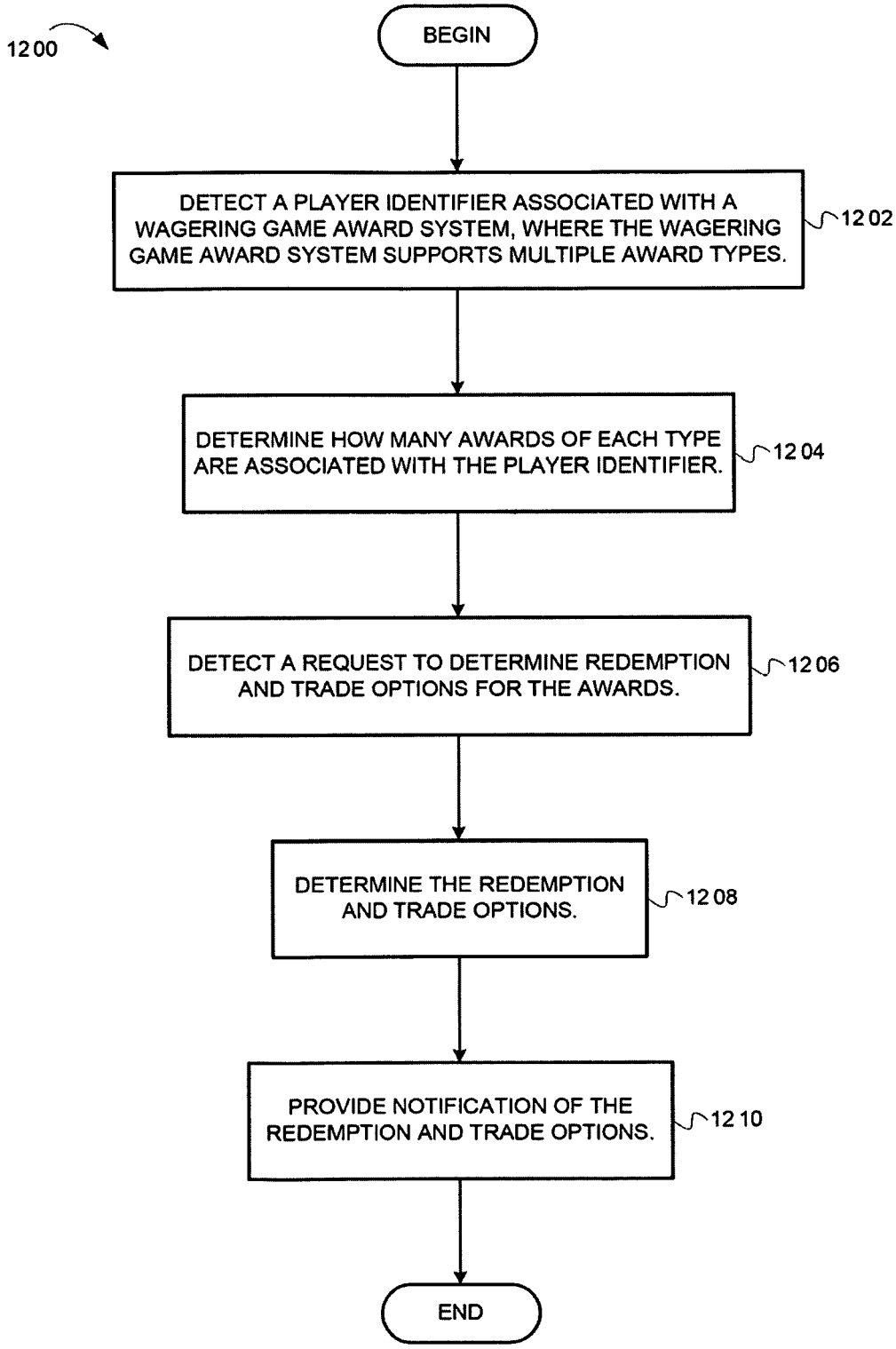
FIG. 12 is a flow diagram illustrating operations for determining redemption and trade options for a certain number of awards, according to example embodiments of the invention.

FIG. 12 is a flow diagram illustrating operations for determining redemption and trade options for players, according to example embodiments of the invention. The flow begins at block 1202.

At block 1202, an award usage tool 444 detects a player identifier associated with a wagering game award system, where the wagering game award system supports multiple award types. In some embodiments, the award usage tool 444 can be used to help players determine how and on what to use their awards. In some embodiments, the award usage tool can implemented as part of the award server 218. In other embodiments, the award usage tool can be located outside the award system server 218 (e.g., as part of a wagering game machine 202, a kiosk 228, or an online server 224). In some embodiments, players can use the award usage tool to determine what products, services, other awards, etc. they can acquire with their awards. The flow continues at block 1204.

At block 1204, the award usage tool 444 determines how many awards of each type are associated with the player identifier. In some embodiments, the award usage tool 444 acquires account information associated with the player identifier from the award account server 226. The flow continues at block 1206.

At block 1206, the award usage tool 444 detects a request to determine redemption and trade options for the awards. In some embodiments, the award usage tool 444 receives the request from a wagering game machine 202, kiosk 228, or online server 224, where the player has indicated a desire to use the award usage tool. The flow continues at block 1208.

At block 1208, the award usage tool 444 determines the redemption and trade options. In some embodiments, tool 444 determines what is available for redemption and trade based on the player's award account balance. For example, if the player had fifty Pointz and seven Coinz, the tool 444 would determine what goods, services, and other awards were available for those amounts. In some embodiments, the tool 444 will suggest redemption items requiring more than the player's account balance, but will suggest activities that will help the player acquire enough awards to purchase the item. The flow continues at block 1210.

At block 1210, the award usage tool 444 provides notification of the redemption and trade options. In some embodiments, the award usage tool 444 provides an interface through which players can buy suggested items and carry-out suggested trades. From block 1210, the flow ends.

Example Wagering Game Machines

Figure 13:
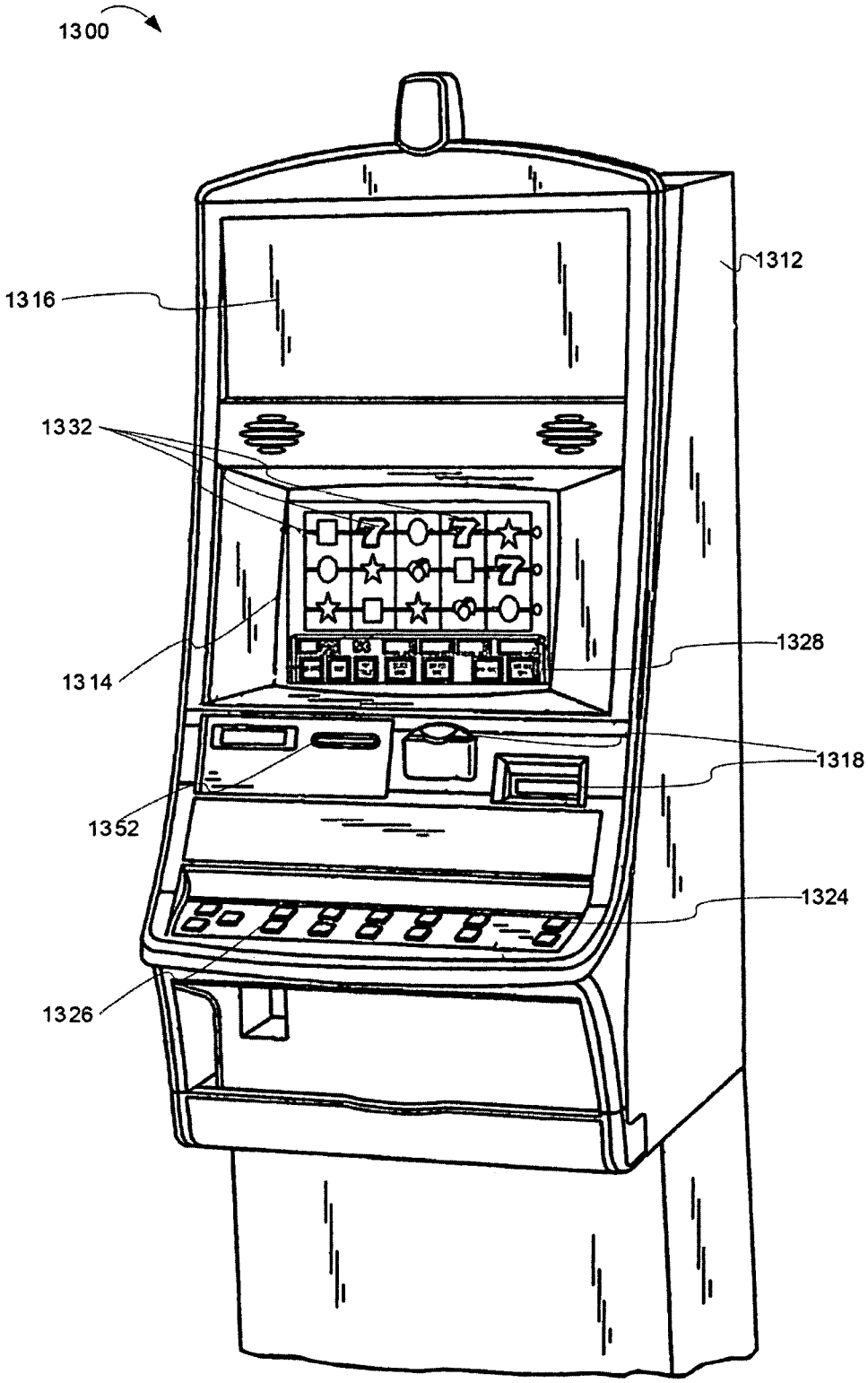
FIG. 13 is a perspective view of a wagering game machine, according to example embodiments of the invention.

FIG. 13 is a perspective view of a wagering game machine, according to example embodiments of the invention. Referring to FIG. 13, a wagering game machine 1300 is used in gaming establishments, such as casinos. According to embodiments, the wagering game machine 1300 can be any type of wagering game machine and can have varying structures and methods of operation. For example, the wagering game machine 1300 can be an electromechanical wagering game machine configured to play mechanical slots, or it can be an electronic wagering game machine configured to play video casino games, such as blackjack, slots, keno, poker, blackjack, roulette, etc.

The wagering game machine 1300 comprises a housing 1312 and includes input devices, including value input devices 1318 and a player input device 1324. For output, the wagering game machine 1300 includes a primary display 1314 for displaying information about a basic wagering game. The primary display 1314 can also display information about a bonus wagering game and a progressive wagering game. The wagering game machine 1300 also includes a secondary display 1316 for displaying wagering game events, wagering game outcomes, and/or signage information. While some components of the wagering game machine 1300 are described herein, numerous other elements can exist and can be used in any number or combination to create varying forms of the wagering game machine 1300.

The value input devices 1318 can take any suitable form and can be located on the front of the housing 1312. The value input devices 1318 can receive currency and/or credits inserted by a player. The value input devices 1318 can include coin acceptors for receiving coin currency and bill acceptors for receiving paper currency. Furthermore, the value input devices 1318 can include ticket readers or barcode scanners for reading information stored on vouchers, cards, or other tangible portable storage devices. The vouchers or cards can authorize access to central accounts, which can transfer money to the wagering game machine 1300.

The player input device 1324 comprises a plurality of push buttons on a button panel 1326 for operating the wagering game machine 1300. In addition, or alternatively, the player input device 1324 can comprise a touch screen 1328 mounted over the primary display 1314 and/or secondary display 1316.

The various components of the wagering game machine 1300 can be connected directly to, or contained within, the housing 1312. Alternatively, some of the wagering game machine's components can be located outside of the housing 1312, while being communicatively coupled with the wagering game machine 1300 using any suitable wired or wireless communication technology.

The operation of the basic wagering game can be displayed to the player on the primary display 1314. The primary display 1314 can also display a bonus game associated with the basic wagering game. The primary display 1314 can include a cathode ray tube (CRT), a high resolution liquid crystal display (LCD), a plasma display, light emitting diodes (LEDS), or any other type of display suitable for use in the wagering game machine 1300. Alternatively, the primary display 1314 can include a number of mechanical reels to display the outcome. In FIG. 13, the wagering game machine 1300 is an "upright" version in which the primary display 1314 is oriented vertically relative to the player. Alternatively, the wagering game machine can be a "slant-top" version in which the primary display 1314 is slanted at about a thirty-degree angle toward the player of the wagering game machine 1300. In yet another embodiment, the wagering game machine 1300 can exhibit any suitable form factor, such as a free standing model, bartop model, mobile handheld model, or workstation console model.

A player begins playing a basic wagering game by making a wager via the value input device 1318. The player can initiate play by using the player input device's buttons or touch screen 1328. The basic game can include arranging a plurality of symbols along a payline 1332, which indicates one or more outcomes of the basic game. Such outcomes can be randomly selected in response to player input. At least one of the outcomes, which can include any variation or combination of symbols, can trigger a bonus game.

In some embodiments, the wagering game machine 1300 can also include an information reader 1352, which can include a card reader, ticket reader, bar code scanner, RFID transceiver, or computer readable storage medium interface. In some embodiments, the information reader 1352 can be used to award complimentary services, restore game assets, track player habits, etc.

General

In the following detailed description, reference is made to specific examples by way of drawings and illustrations. These examples are described in sufficient detail to enable those skilled in the art to practice the inventive subject matter, and serve to illustrate how the inventive subject matter can be applied to various purposes or embodiments. Other embodiments are included within the inventive subject matter, as logical, mechanical, electrical, and other changes can be made to the example embodiments described herein. Features or limitations of various embodiments described herein, however essential to the example embodiments in which they are incorporated, do not limit the inventive subject matter as a whole, and any reference to the invention, its elements, operation, and application are not limiting as a whole, but serve only to define these example embodiments. The following detailed description does not, therefore, limit embodiments of the invention, which are defined only by the appended claims.

Each of the embodiments described herein are contemplated as failing within the inventive subject matter, which is set forth in the following claims.

The invention claimed is:

1. A method comprising:

detecting a player identifier associated with an electronic wagering game award system, where the wagering game award system supports a plurality of award types;

determining a number of awards of a first type, wherein the number of awards of the first type are associated with the player identifier, and wherein the first type is one of the award types;

detecting a request to exchange some of the number of awards of the first type for awards of a second type, wherein the second type is one of the plurality of award types, and wherein the awards of the second type are exchangeable within the electronic wagering game award system for other awards of the plurality of award types;

submitting the request.

2. The method of claim 1, further comprising:

detecting a result of the request; and presenting the result of the request.

3. The method of claim 1, wherein before the request, the awards of the first type belong to a player associated with the player identifier, and wherein the awards of the second type belong to another player.

4. The method of claim 1, wherein before the request, the awards of the first type belong to a player associated with the player identifier, and wherein the awards of the second type do not belong to another player.

5. The method of claim 1, wherein the first type and the second type are not currency issued by a world government.

6. The method of claim 1, submitting the request includes, transmitting the request to an award system server, and wherein a result of the request is received from the award server.

7. The method of claim 1, wherein the determining the number of awards of the first type includes obtaining information from an award system server or a player tracking card.

8. The method of claim 1, wherein the awards of the first type were given to a player associated with the player identifier by a third-party marketer operating with the wagering game award system or another player associated with the wagering game award system.

9. The method of claim 8, wherein the third-party marketer is selected from the group consisting of a casino system, a service provider, a goods provider, or an advertiser.

10. The method of claim 1, wherein the awards of the first type were given to a player associated with the player identifier by another player associated with the wagering game system, wherein the other player had received the awards with a stipulation that the awards must be given away.

11. The method of claim 1, wherein a certain one of the number of awards is a mystery award, and wherein the value of the certain one of the number of awards is hidden.

12. A method for a third-party marketer to purchase awards in an electronic wagering game system and distribute the awards to players of the wagering game system, the method comprising:

submitting an electronic request to purchase awards in the wagering game system, wherein the awards are of one or more types;

detecting an electronic indication that the awards have been purchased;

determining electronic wagering game system activities which, when performed by one or more of the players, makes the one or more of the players eligible to receive ones of the awards; and requesting electronic transfer of the ones of the awards to accounts associated with players of the wagering game system that have performed the wagering game activities.

13. The method of claim 12, wherein the wagering game system activities are selected from the group consisting of watching an advertisement online, watching an advertisement on a wagering game machine, playing a certain wagering game machine.

14. The method of claim 12, wherein the awards of the particular type are redeemable for money.

15. The method of claim 12, wherein the awards of the particular type are redeemable for awards of another type.

16. A method comprising:

determining awards associated with a player, wherein the player acquired the awards for activities in a wagering game system and online activities outside the wagering game system, and wherein the awards are of a plurality of types;

providing information indicating items for which the awards can be redeemed;

detecting a request to redeem one or more of the awards for one of the items; and performing the redemption.

17. The method of claim 16, wherein the items are selected from the group consisting of online services, awards of the plurality of types, merchandise, and goods.

18. The method of claim 16, wherein the online activities include one or more of contributing content, playing online games, and watching online videos.

19. The method of claim 16, wherein some of the awards associated with the player have been assigned a cash value by the wagering game system.

20. The method of claim 16, wherein the items are selected from the group of wagering game features consisting of a free spin, a re-spin, a shield from a game terminating event, and a bonus round activator.

21. A method comprising:

detecting online activities and activities in an electronic wagering game system;

distributing, to accounts associated with player identifiers, awards for the online activities and the activities in the electronic wagering game system, wherein the awards are of a plurality of types including a first award type, second award type, and third award type, wherein the awards of the first, second, and third award types are redeemable for each other;

detecting requests to redeem ones of the awards of the first award type for awards of the second and third award types;

redeeming, in the accounts associated with the player identifiers, the ones of the awards of the first award type for the awards of the second and third award types;

detecting requests to redeem the awards of the second and third award types for value including goods, services, and wagering game pieces for use in the electronic wagering game system.

22. The method of claim 21, wherein certain of the awards must be given away from ones of the players associated with the player identifies to others of the players associated with the player identifiers.

23. The method of claim 21, wherein the online activities include one or more of contributing content, playing online games, and watching online videos.

24. The method of claim 21 wherein the activities in the electronic wagering game system include placing wagers on wagering games and winning wagering games.

* * * * *